United States Patent [19]

Eichelberger et al.

[11] 4,438,158

[45] Mar. 20, 1984

[54] METHOD FOR FABRICATION OF ELECTRICAL RESISTOR

[75] Inventors: Charles W. Eichelberger, Schenectady; Robert J. Wojnarowski, Clifton Park, both of N.Y.

[73] Assignee: General Electric Company, Schenectady, N.Y.

[21] Appl. No.: 437,046

[22] Filed: Oct. 27, 1982

Related U.S. Application Data

[62] Division of Ser. No. 220,937, Dec. 29, 1980, Pat. No. 4,377,505.

[51] Int. Cl.[3] ..... B05D 5/12; H01C 7/00

[52] U.S. Cl. ..... 427/101; 427/126.3; 427/304; 427/306; 427/372.2; 427/380; 427/385.5; 252/518; 338/20; 338/308; 524/406; 524/430

[58] Field of Search ..... 252/511, 512, 515, 518; 338/20, 308; 106/1.05, 1.12, 1.22; 524/406, 430, 431, 432, 435, 439; 427/101, 102, 103, 126.3, 372.2, 385.5, 380, 304, 306; 428/328

[56] References Cited

U.S. PATENT DOCUMENTS

| | | | |
|---|---|---|---|
| 3,764,280 | 10/1973 | Lupinski | 427/126.3 |
| 4,053,866 | 10/1977 | Merz et al. | 252/515 |
| 4,087,778 | 5/1978 | Merz et al. | 252/515 |
| 4,097,415 | 6/1978 | Moulin et al. | 252/512 |
| 4,135,030 | 1/1979 | Basche | 428/304 |
| 4,172,922 | 10/1979 | Merz et al. | 252/518 |
| 4,277,542 | 7/1981 | Boonstra et al. | 252/518 |
| 4,312,770 | 1/1982 | Yu et al. | 252/514 |

*Primary Examiner*—John D. Smith
*Assistant Examiner*—Richard Bueker
*Attorney, Agent, or Firm*—Geoffrey H. Krauss; James C. Davis, Jr.; Marvin Snyder

[57] ABSTRACT

An electrical resistor family based on oxides of tungsten and/or molybdenum is prepared by combining a polymeric binder with such oxides in an appropriate amount to realize the desired bulk properties. The resistance of the composite can be varied by varying the metal content of the oxides and/or by appropriate combination of the various oxides. Inert fillers are not required and the bulk properties are more stable.

11 Claims, No Drawings

METHOD FOR FABRICATION OF ELECTRICAL RESISTOR

This application is a division of application Ser. No. 220,937, filed Dec. 29, 1980, now U.S. Pat. No. 4,377,505.

BACKGROUND OF THE INVENTION

In order to prepare thick-film resistors, a mixture of an appropriate resistor material, a ceramic or glass binder and an appropriate vehicle is screen printed on a substrate. The resistor pattern on the substrate is then fired at a relatively high temperature, typically between 650° and 900° C. As the temperature rises to the firing temperature, the vehicle is volatilized, leaving the resistance material and binder behind. At the firing temperature, sintering takes place to a greater or lesser extent, with the binder providing adhesion between the resistor material and the substrate.

All known thick-film resistor systems which are compatible with polymer conductors and the like depend on contact between particles of the resistor material, which is held by the polymeric binder. The resistance value of the system is dependent on the materials incorporated into the binder. Thus, if a high resistivity material is incorporated into the polymer, the resulting resistor will have a high resistance. Alternatively, a high resistivity material can be obtained by incorporating a relatively low resistivity material in the polymer together with a portion of an inert filler material, such as silica. The filler acts to decrease the percentage of particle-to-particle contact between the particles of low resistivity, resulting in an overall high resistance material. A second alternative is to use a relatively high resistivity material and a high conductivity filler, such as silver or platinum; such a formulation will result in a resistor of low resistivity.

In the past, systems employing fillers have been used to obtain families of resistor "inks", i.e. a series of thick film resistor materials having different resistance values as a result of varying the type of filler and amount of filler. A basic problem with this approach is that the resistivity of the filler material is vastly different from the resistivity of the basic resistance material. For example, for all practical purposes, silica has an essentially infinite resistance while silver or platinum have essentially no resistance. The resistance of the composite resistor ink is highly dependent on inter-particle contact. As a result, the stability of the resistor system is adversely affected.

Resistor systems which are compatible with polymer conductors are based on polymeric binders. However, a polymeric binder has the deficiency that the compressive forces created by and within the binder are dependent on temperature and humidity conditions, which can vary considerably from time to time and from place to place. It will therefore be appreciated that a resistor system which depends on varying the amount of inter-particle contact between highly conducting or non-conducting species and a bulk resistive species is inherently unstable in the presence of variations in polymer characteristics with temperature and humidity.

Another problem with thick-film polymer resistor materials is that of cost. At the present time, virtually all of such materials are based on mixtures of ruthenium oxide and various amounts of silver, palladium and platinum. These materials are all rare and are characterized as precious and are, therefore, very expensive. For example, a typical rutherium oxide resistor paste presently costs somewhere in the neighborhood of about $2.00 per gram.

Carbon is a material of known resistivity and carbon composition resistors have been used in electronic circuits for essentially the last century. Resistor inks based on carbon are commercially available. Using carbon in some polymer systems, however, does give rise to problems because the carbon tends to react with the free radical cure mechanism of the polymeric system and prevent proper curing of the binder. Powdered graphite can be used as a substitute in these systems. The preparation of a family of resistor inks based on carbon or graphite is difficult, however, because of the aforementioned problems associated with the filler materials. In addition, carbon resistors of all types are characterized by having poor temperature coefficients. Moreover, degradation of the stability of the resistor results from the softness of carbon and the ability to change the amount of contact surface between particles as a result of relatively small amounts of expansion and contraction of the polymer resistor system.

Accordingly, it is the object of this invention to provide a family of resistor inks having various resistance, in which optimal loading of a polymeric binder with resistive material, without the use of high conductivity or inert fillers, can be realized and with relatively high stability when subject to temperature variations, humidity variations and atmospheric oxidizing conditions. The invention is based on low cost materials, and is dependent on the bulk resistivity properties of the resistor material and less dependent on surface properties which can vary with changes in ambient conditions. The resistive material is sufficiently hard to resist shape changes which tend to result in loss of particle contact when there are changes in particle-to-particle pressure brought about by natural variation of ambient conditions. These and other objects of the invention will become apparent to those skilled in the art from the following detailed discussion.

SUMMARY OF THE INVENTION

In accordance with the invention, a family of electrical resistors are based on oxides of tungsten and molybdenum. More particularly, a family of resistors in which the resistance value is based on the oxidation state and/or combinations of the various oxides of molybdenum and tungsten is taught. The invention also relates to the method of preparing the various electrical resistors.

DESCRIPTION OF THE INVENTION

In accordance with the present invention, an electrical resistor is prepared by combining a curable polymeric binder with one or more of the oxides of molybdenum and tungsten. The resistor "ink", i.e. the mixture of the binder and oxides, can be applied to various substrates and the binder cured. It will be appreciated that the present invention is particularly adapted to be used in connection with screen printing techniques to establish the resistor patterns on substrates, although the invention is not so limited. Other types of printing and application techniques can be used including, without limitation, pad flexographic printing, stencil, rotogravure and offset printing.

The substrate on which the resistor is formed is not particularly restricted and any insulator or conductor to which the polymeric binder can be adhered is employable. Thus, the usual printed circuit substrates can be used, as well as glass filled polyesters, phenolic boards, polystyrene, and the like.

For convenience purposes, the invention will be primarily described below in terms of the various oxides of tungsten although it will be appreciated that similar performance and results can be obtained using the various oxides of molybdenum.

The formula for any given tungsten oxide is complex in that the ratio of tungsten and oxygen is not expressed by a single small integer. Tungsten oxides can vary from $WO_2$ to $WO_3$. As a result, the tungsten oxides are generally referred to by their characteristic color which, in turn, depends on the tungsten-to-oxygen ratio in the oxide molecule, which in turn is dependent on the oxidation state of the metal. For example, the following table shows the approximate formulation and the characteristic colors for several oxides of tungsten:

TABLE 1

| Approximate Formula | Oxide Color |
|---|---|
| $WO_2$ | Brown |
| $W_2O_5$ | Purple |
| $W_4O_{11}$ | Blue |
| $WO_3$ | Yellow |

It will be noted that the order of decreasing percentage of tungsten by weight results in oxides whose characteristic color runs from brown to purple to blue to yellow.

In resistor systems which depend on contact between adjacent particles in a binder material, a material which is already in an oxide form is preferred because oxidation in air tends to result in the formation of an insulation barrier between adjacent particles. Indeed, it is this phenomena which pevents the use of non-noble metals in the formation of polymer conductors. The oxides of both tungsten and molybdenum provide the highly desirable feature of being an oxide as well as being a bulk-resistive material. In addition, these oxides are very hard and do not tend to change shape or chalk under pressure changes which occur due to the natural thermal expansion of a resistor ink system. Employment of these oxides is also advantageous because they tend to maintain the same area of particle-to-particle contact, as a result of being essentially incompressible over the compression level variations normally associated with the polymeric binder.

The resistor inks used in the present invention are a combination of the molybdenum and/or tungsten oxides with a curable polymer and also, if desired or convenient, a solvent adapted to control the viscosity and flow characteristics of the polymeric binder. The tungsten and molybdenum oxides are preferably used in finely divided form having a particle size of less than about 50 microns, preferably 3 to about 25 microns and most preferably less than 10 microns. It will be appreciated that when the resistor ink is to be deposited by screen printing, the oxide particles must be of a size to pass through the screen.

The polymers employed in the ink are any curable material or mixture thereof which exhibits a degree of adhesion to the substrate being employed and to the tungsten and/or molybdenum oxide which is dispersed therein. Typical polymers which can be employed include the homopolymers and copolymers of ethylenically unsaturated aliphatic, alicyclic and aromatic hydrocarbons such as polyethylene, polypropylene, polybutene, ethylene propylene copolymers, copolymers of ethylene or propylene with other olefins, polybutadiene, polyisoprene, polystyrene and polymers of pentene, hexene, heptene, bicyclo-(2,2,1)2-heptane, methyl styrene and the like. Other polymers which can be used include polyindene, polymers of acrylate esters and polymers of methacrylate esters, acrylate and methacrylate resins such as ethyl acrylate, n-butyl methacrylate, isobutyl methacrylate, ethyl methacrylate and methyl methacrylate; alkyd resins; cellulose derivatives such as cellulose acetate, cellulose acetate butyrate, cellulose nitrate, ethyl cellulose, hydroxyethyl cellulose, methyl cellulose, and sodium carboxymethyl cellulose; epoxy resins; hydrocarbon resins from petroleum; isobutylene resins; isocyanate resins (polyurethanes); melamine resins such as melamine-formaldehyde and melamine-urea-formaldehyde; oleo-resins; polyamide polymers such as polyamides and polyamide-epoxy polyesters; polyester resins such as the unsaturated polyesters of dibasic acids and dihydroxy compounds; polyester elastomer and resorcinol resins such as resorcinol-formaldehyde, resorcinol-furfural, resorcinol-phenol-formaldehyde and resorcinol-urea; rubbers such as natural rubber, reclaimed rubber, chlorinated rubber, butadiene styrene rubber, and butyl rubber, neoprene rubber, polysulfide, vinyl acetate and vinyl alcohol-acetate copolymers, polyvinyl alcohol, polyvinyl chloride, polyvinyl pyrollidone and polyvinylidene chloride, polycarbonates, graft copolymers of polymers of unsaturated hydrocarbons and of unsaturated monomers such as graft copolymers of polybutadiene, styrene and acrylonitrile, commonly called ABS resins, polyamides and the like, including such other materials as described in allowed co-pending application Ser. No. 220,342, filed Dec. 29, 1980, now U.S. Pat. No. 4,404,237, assigned to the assignee of the present invention and, incorporated herein by reference in its entirety.

The resistor inks of the present invention can contain various other materials such as dyes, pigments, waxes, stabilizers, lubricants, curing catalysts such as peroxides, photosensitizers and amines, polymerization inhibitors and the like. It is preferred however, but not essential, to avoid the use of a filler.

Many resistor systems of the prior art obtain different resistivities by incorporating a filler which is per se either conductive or insulating. When the filler is vastly different in resistivity from the basic resistive material in such systems, it will have a substantial effect on the net value of the resistance realized. This is a function of the fact that a relatively large change in the resultant resistance can be achieved by a small change in the filler content. In the present system, fillers having vastly different resistivities from that of the tungsten and/or molybdenum oxides are used only should it become necessary to adjust the temperature or humidity coefficients of the resistor ink. In such instances, the fillers can be used to achieve a balance of applied pressure to the system or inverse resistive characteristics to match thermal coefficients of the base material. In the usual case, however, no filler will be used.

The amount of the oxide used in combination with the curable polymer is that amount sufficient to realize sufficient particle-to-particle contact so that a desired degree of opposition to change of bulk resistivity properties, due to variation in ambient conditions, is realized. In general, the oxides will constitute about 60–80% by volume of the mixture after curing and preferably the oxides are about 70% by volume. Variations in the resistance value of the resistor per se is achieved by varying the particular oxides used, rather than their amount. This feature of the invention is evident from the following table 2 in which is set forth in the resistances obtained when various amounts of the different oxides were mixed together and incorporated in the polymeric binder. In each case, the oxide or combination of oxides set forth in the table was mixed with a polymeric binder which contained about 60% of a polyester resin and about 40% of diethylene glycol monobutylether such that the amount of the oxide powder was about 70 volume % of the admixture after curing. The admixture was then applied to a substrate and cured by heating to a temperature of about 180° C. for about 30 minutes to form a 10 mil thick smear of the cured resistor ink on the substrate. It will be appreciated that this is thicker than resistors obtained by screen printing processes, which are usually on the order of about 1 mil.

TABLE 2

| Oxide Type | Resistance of 10 Mil Thick Smear |
|---|---|
| Molybdenum (Brown) | 2 ohms per square |
| ½ Molybdenum (Brown) + ½ Tungsten (Brown) | 3-4 ohms per square |
| Tungsten (Brown) | 10 ohms per square |
| Tungsten (Purple) | 10 ohms per square |
| Tungsten (Blue) | 2 Kohms per square |
| ⅔ Tungsten (Yellow) + ⅓ Tungsten (Blue) | 500 Kohms per square |
| Tungsten (Yellow) | 1,000 Kohms per square |

A solvent can be used in the ink formulation in order to adjust the viscosity and flow characteristics for the type of printing desired. In general, the solvent should be employed in an amount sufficient that the ink has a viscosity of 15,000-200,000 cps at room temperature and preferably about 50,000-150,000 cps. Sutiable solvents or diluents can be aliphatic or aromatic and usually contain up to about 30 carbon atoms. They include the hydrocarbons, ethers and thioethers, carbonyl compounds such as esters and ketones, nitrogen containing compounds such as amides, amines, nitriles and nitro compounds, alcohols, phenols, mercaptans and halogen containing compounds. Examples include alcohols such as methanol, ethanol, propanol, benzyl alcohol, cyclohexanol, ethylene glycol, glycerol and the like, aromatic materials such as benzene, toluene, xylene, ethyl benzene, napthalene, tetralin and the like, ethers such as methyl ether, ethyl ether, propyl ether, methyl t-butyl ether, and the like, alkanes such as methane, ethane, propane and the like, dimethyl sulfoxide, butyl formate, methyl acetate, ethyl acetate, formamide, dimethyl formamide, acetamide, acetone, nitrobenzene, monochloro-benzene, acetophenone, tetrahydrofuran, chloroform, carbon tetrachloride, trichloroethylene, ethylbromide, phenol, mercaptophenol, and the like. Additionally, reactive solvents or diluents such as triallyl isocyanurate can be used if desired. It is preferred to employ a solvent which is relatively non-volatile at room temperature so that the viscosity and flow of the ink is appropriate during application to the substrate and highly volatile at the curing temperature of the polymer or at other temperatures above the application temperature. The carbitol series of solvents and particularly butyl carbitol (diethylene glycol monobutyl ether) has been found to be particularly appropriate.

The ink is applied to the substrate to achieve the desired resistor patterns thereon. For example, standard printed circuit application technology can be employed. Any temperature which will not cause premature curing of the ink and at which the viscosity and flow characteristics of the ink are appropriate to the application technique used can be employed. When a solvent is utilized, it is preferred, but not necessary, to permit at least a portion of the solvent to evaporate after application of the ink to the substrate and before curing in order to facilitate the curing reaction. Preferably, the drying is effected for 0.1-1 hour and more preferably about 0.25-0.5 hour, at a temperature of about 70°-150° C., most preferably about 110°-130° C.

In the next step in the instant process, the ink polymer is cured or polymerized by the most convenient method. If an autocatalyst has been added, the polymer will cure by itself with no additional initiation. In the case of ultraviolet light initiators, the substrates carrying the conductor patterns can be passed under a high intensity ultraviolet source which causes the initiators to begin the curing reaction. It is presently preferred to employ a thermal curing system which is activated by exposure to temperatures of about 140°-200° C., preferably about 150°-180° C., for a time of 0.1-1 hour, preferably 0.15-0.5 hour. As a result of this step, a closely compacted oxide powder, bound to the substrate by the cured polymer, is achieved.

One particularly interesting application of the resistor family of the present invention is in connection with the electrical conductors fabricated by an augmentation replacement reaction as described in copending application Ser. No. 220,342, now U.S. Pat. No. 4,404,237. That system utilizes a conductor ink which is similar to the instant resistor ink except that a finely divided metal is employed rather than an oxide of tungsten and/or molybdenum. After curing, the ink is contacted with a solution of a metal salt in which the metal is more noble than the metal carried in the ink so that a simultaneous exchange of metals between the ink and the solution and a plating of the surface of the ink with the more noble metal is achieved. If desired, the polymer resistor ink of the present invention can be loaded with a small weight percentage of a metal powder which can take place in the augmentative replacement reaction, for example, iron or zinc. Since the metal powder is readily oxidized on the surface, it will act only as an inert filler in terms of affecting the resistance of the cured polymer resistor material. However, when the augmentation replacement reaction is effected, some of the metal powder will be dissolved (oxidized) with a noble metal layer forming on both the surface of the metal powder and the resistor material. As a result, a more adherent resistor-conductor junction is achieved.

Various changes and modifications can be made in the present invention without departing from the spirit and scope thereof. The various embodiments which have been disclosed herein were for the purpose of further illustrating the invention but were not intended to limit it.

What is claimed is:

1. A method for preparing an electrical resistor, comprising the steps of: combining a curable polymeric binder and finely-divided particles, having a particle size of less than 50 microns, of at least one member of the group consisting of the brown oxide of molybdenum and the brown, purple, blue and yellow oxides of tungsten; adjusting the amount of said oxides to be about 60-80 volume percent of the mixture of said oxides and said binder and sufficient to provide a desired bulk resistivity after curing; applying the resulting admixture to a substrate; and curing said binder.

2. The method of claim 1, wherein the amount of said oxides is about 70%.

3. The method of claim 1, wherein said oxides are employed in powdered form.

4. The method of claim 3, wherein said at least one member of the group is at least one of the brown, purple, blue and yellow oxides of tungsten.

5. The method of claim 3, wherein said at least one member of the group is the brown oxide of molybdenum.

6. The method of claim 3, wherein said at least one member of the group is a mixture of at least the brown oxide of tungsten and said brown molybdenum oxide.

7. The method of claim 1, further comprising the step of combining said curable binder and oxides with a solvent in an amount sufficient to establish a desired viscosity and flow characteristic of the resulting admixture.

8. The method of claim 7, further comprising the step of drying said admixture after application to the substrate and before curing said binder.

9. The method of claim 1, wherein said curable polymeric binder is a polyester resin and said binder is cured thermally.

10. A method of fabricating an electrical resistor of desired resistance value which comprises the steps of: providing an oxide material comprising at least one member or a mixture of members of the group consisting of the brown, purple, blue and yellow oxides of tungsten; admixing an amount of the oxide material, selected to provide a desired resistance value, with a curable polymeric binder; and curing the binder.

11. A method of fabricating an electrical resistor of desired resistance value which comprises the steps of: providing an oxide material comprising a mixture of the brown oxide of molybdenum and at least one of the brown, purple, blue and yellow oxides of tungsten; admixing an amount of the oxide material, selected to provide a desired resistance value, with a curable polymeric binder; and curing the binder.

* * * * *